United States Patent [19]

Lu

[11] Patent Number: 4,533,229

[45] Date of Patent: Aug. 6, 1985

[54] MAGNETIC BRUSH DEVELOPER APPARATUS

[75] Inventor: Wei C. Lu, Rochester, N.Y.

[73] Assignee: Eastman Kodak Company, Rochester, N.Y.

[21] Appl. No.: 474,901

[22] Filed: Mar. 14, 1983

[51] Int. Cl.[3] ..... G03G 15/08

[52] U.S. Cl. ..... 355/3 DD; 355/14 D; 118/657; 118/658; 430/122

[58] Field of Search ..... 355/3 DD, 14 D; 118/657, 658, 622; 430/122, 125

[56] References Cited

U.S. PATENT DOCUMENTS

| | | | |
|---|---|---|---|
| 3,593,166 | 7/1971 | Wu | 118/657 X |
| 3,741,790 | 6/1973 | Wu | 430/122 X |
| 4,139,296 | 2/1979 | Ruckdeschel | 355/3 DD |
| 4,266,503 | 5/1981 | Uehara et al. | 118/657 |
| 4,393,810 | 7/1983 | Kasper | 355/3 DD |

FOREIGN PATENT DOCUMENTS

| | | |
|---|---|---|
| 48-4329578 | 8/1973 | Japan . |
| 48-4329678 | 8/1973 | Japan . |
| 2022468 | 12/1979 | United Kingdom . |

*Primary Examiner*—A. C. Prescott

*Attorney, Agent, or Firm*—Larry P. Kessler

[57] ABSTRACT

A magnetic brush developer apparatus for developing an electrostatic charge pattern on a member by contacting the member with particulate magnetic developer material, such material being contained within the zone of contact to prevent uncontrolled escape from the zone and contamination of the environs. The apparatus includes an applicator for transporting developer material in a non-agitated state into contact with the charge pattern on the member. A portion of the developer material in contact with such charge pattern is magnetically agitated to form in such material an agitated zone bounded by the non-agitated material to establish a sealing zone about the agitated zone.

4 Claims, 3 Drawing Figures

MAGNETIC BRUSH DEVELOPER APPARATUS

BACKGROUND OF THE INVENTION

This invention relates in general to magnetic brush developer apparatus for electrographic reproduction equipment, and more particularly to magnetic brush developer apparatus having an agitated developer nap bounded by a non-agitated, sealing, developer nap.

In the electrographic process for making reproductions of input information, an electrostatic charge pattern is formed on the surface of an insulating member in image-wise configuration corresponding to the information to be reproduced. The charge pattern is developed by applying developer material to such pattern to form a visible image. The visible developer material image is then either transferred to a receiver member and fixed to such member, or fixed to the insulating member itself. In commercial high speed electrographic reproduction equipment, a common mechanism for developing electrostatic charge patterns is a magnetic brush developer apparatus.

A typical magnetic brush developer apparatus includes one or more magnets located within an applicator member. The applicator member may rotate about fixed magnets, the magnets may rotate wtihin a fixed applicator member, or both may rotate in the same or opposite directions. Developer material comprises, for example, a mixture of finely divided pigmented thermoplastic marking particles (toner) held to the surface of ferromagnetic particles (carrier) by electrostatic charges created by triboelectrification. The carrier particles, with the attached toner particles, are held on the applicator member in a bristle-like formation by the magnetic fields of the magnets to form a brush nap. Of course, developer material of the type comprised solely of marking particles which exhibit magnetic properties (referred to as single component developer) is also suitable. The developer material is then brought into contact with the electrostatic charge pattern by brushing the nap bristles across the surface of the insulating member. When the developer material contacts the surface of the insulating member, the electrostatic attraction for the triboelectrically charged toner particles by the charge pattern on the insulating member overcomes the attraction of the carrier particles for the toner particles (or the magnetic attraction for single component developer) and the pattern is developed; see, for example, U.S. Pat. No. 3,703,395, issued Nov. 21, 1972 in the name of Drexler et al.

Due to the fact that the developer material is presented to the charge pattern in that segment of the nap bristles contacting the insulating member, only a portion of the total amount of material in the bristles is available to carry out development. In most instances sufficient developer material is available for complete charge pattern development; however when the insulating member is moving at a relatively high speed through the developer material, or when the iunsulating member has a large area of dense charge patterns for example, there may be insufficient material in the segment of the bristles contacting the charge pattern for complete development. This results in defects in the developed image such as washed out areas or white streaks or spots in the reproduction. One arrangement for increasing the available developer material is shown in the Research Disclosure Bulletin of August 1982 at p. 299 (No. 22010). In this arrangement, the nap bristles on an applicator shell are agitated throughout the development zone by counter rotating magnets adjacent to the development zone. Such agitation causes the bristles to tumble or flip so that an increased amount of developer material is available for charge pattern development; however, it may also result in the escaping of some particles from the confinement of or positional control of the magnetic fields, which particles have the potential for contaminating the interior of the reproduction equipment.

SUMMARY OF THE INVENTION

This invention is directed to a magnetic brush developer apparatus for developing an electrostatic charge pattern on a member by contacting the member with particulate magnetic developer material, such material being contained within the zone of contact to prevent uncontrolled escape from the zone and contamination of the environs. The apparatus includes an applicator for transporting developer material in a non-agitated state into contact with the charge pattern on the member. A portion of the developer material in contact with such charge pattern is magnetically agitated to form, in such material, an agitated zone bounded by the non-agitated material to establish a sealing zone about the agitated zone.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
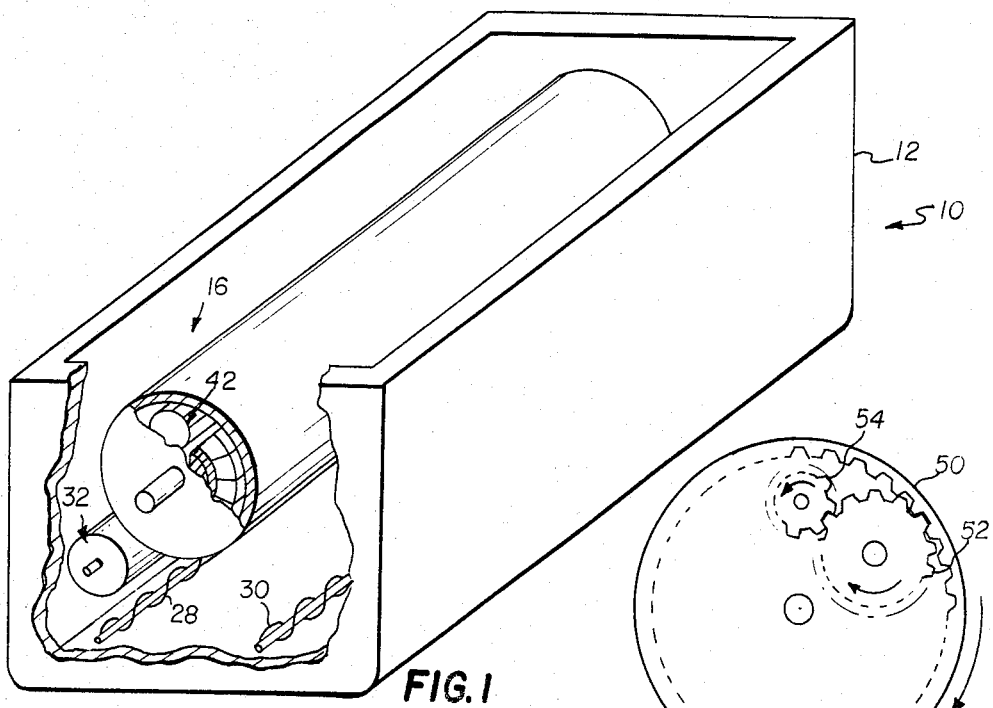
FIG. 1 is isometric view of a magnetic brush developer apparatus incorporating the magnetic developer material agitator according to this invention, with portions broken away to facilitate viewing.
Figure 2:
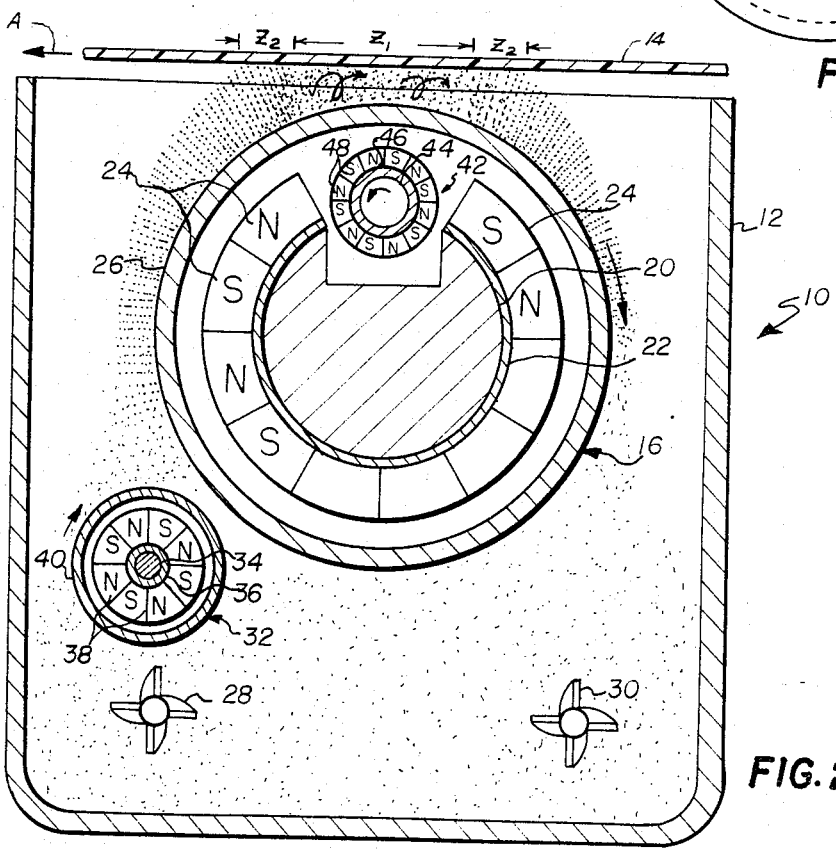
FIG. 2 is an end view, in cross-section, of the apparatus of FIG. 1.

Referring now to the accompanying drawings, a magnetic brush developer apparatus, designated generally by the numeral 10, is shown in FIGS. 1 and 2. The apparatus 10 includes a housing 12 forming a reservoir for particulate developer material T. The housing 12 is located in juxtaposition to a member 14 movable in the direction of arrow A (see FIG. 2). The member 14 is an insulating member capable of retaining electrostatic charge patterns and, on movement, carries such patterns into pattern developing relation with the apparatus 10. An applicator 16 is mounted in the housing 12 for transporting developer material into contact with a charge pattern on the member 14. It is, of course, within the scope of this invention for the apparatus 10 to have any suitable number of applicators.

The applicator 16 includes a stationary substantially cylindrical core 20 of non-magnetic material, such as aluminum for example. The longitudinal axis of the core 20 extends laterally with respect to the member 14 perpendicular to its direction of travel. A stationary magnetic pole piece 22 is adhesively bonded to the core 20. A plurality of permanent magnets 24, of rubber-bonded barium ferrite strips for example, are fixed on a portion of the periphery of the pole piece 22. A shell 26, rotatably mounted in the housing 12 concentrically with the core 20, surrounds the magnet arrangement in the field of the permanent magnets. The shell is a hollow cylinder or tube of non-magnetic material, such as aluminum, with a roughened peripheral surface.

Augers 28 and 30 supported in the housing 12 to extend through the developer material T are rotated to circulate the developer material in the housing and distribute it along the length of shell 26. In the instance when the developer material includes carrier particles and toner particles, such circulation also causes the toner particles to develop a triboelectric charge which results in the adhering of the toner particles to the carrier particles. A feed member 32 transports developer material from the reservoir to the shell 26. The feed member, which is similar in construction to the applicator 16, includes a stationary cylindrical core 34, a pole piece 36, permanent magnets 38 (producing magnetic fields of relatively lesser strength than the magnet fields produced by magnets 24), and a rotatable shell 40. As the shell 40 rotates, the carrier particles and adhering toner particles (or the single component developer material) are held on the roughened peripheral surface of such shell by the magnetic fields of the permanent magnets 38 and are transported to the shell 26. The developer material is transferred from shell 40 to shell 26 by the relatively stronger magnetic fields of the magnets 24 and held on the surface of shell 26. The particles are established as a brush nap in the form of bristles extending radially from the shell 26 in the fields of the magnets 24. As the shell 26 rotates the bristles are moved into contact with the charge pattern bearing member 14.

Figure 3:
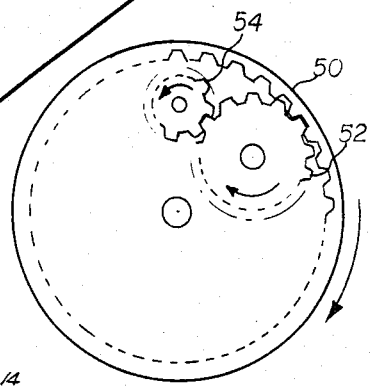
FIG. 3 is an end view of the applicator shell and magnetic agitator drive mechanism.

A magnetic agitator 42 is mounted in the shell 26 within a cutout 20' in core 20 adjacent to the area over which the brush nap contacts the member 14. The agitator 42 includes a rotatable core 44 to which a pole piece 46 is adhesively bonded. A plurality of permanent magnets 48, similar to magnets 24 are fixed on the periphery of the pole piece 46. Rotation of the agitator is in the opposite direction to rotation of the shell 26. The gear arrangement shown in FIG. 3 effects such rotation. In such gear arrangement, a ring gear 50 fixed to the shell 26 rotates, for example, clockwise as the shell is rotated. An idler gear 52 supported by the core 20, for example, and meshing with the ring gear then rotates the gear 54, fixed to the agitator 42, counterclockwise.

The relative diameters of the gears are selected to rotate the agitator 42 at a substantially increased angular velocity with respect to the shell 26, such as in the ratio of 25 to 1 for example. The increased angular velocity, the opposing directions of rotation of the agitator 42 and shell 26, and the location of the agitator 42 with respect to the magnets 24, cause the developer material in contact with the charge pattern bearing member 14 to be divided into two zones. In the first zone, designated $Z_1$ in FIG. 2, the developer material is rapidly agitated, or tumbled. That is the bristles rapidly flip end-for-end, in effect breaking up the brush nap and causing a greater portion of the bristles to contact the member 14. Therefore, a relatively increased amount of developer material is presented to the charge pattern on the member for improved development of such charge pattern. In the second zone, designated $Z_2$, the bristles remain intact, in a non-agitated state (i.e. extending radially from the shell 26), and bound the zone $Z_1$. The bristles in zone $Z_2$, by their contact with member 14, therefore form a curtain and effect a seal about the material in zone $Z_1$ to retain the agitated developer material within such zone inhibiting uncontrolled escape of material. The agitated developer material is thereby contained within zone $Z_1$, and contamination of the environs of the developer apparatus 10 is substantially prevented.

The invention has been described in detail with particular reference to a preferred embodiment thereof, but it will be understood that variations and modifications can be effected within the spirit and scope of the invention.

I claim:

1. In magnetic brush developer apparatus for developing an electrostatic charge pattern on a member by contacting the member with particulate magnetic developer material, said apparatus including applicator means for transporting such developer material in a non-agitated state into contact with such charge pattern, the improvement comprising:

magnetic means, operatively associated with said applicator means, for agitating a portion of developer material in contact with such charge pattern to form in such material an agitated zone bounded by the non-agitated material to establish a sealing zone about the agitated zone.

2. The invention of claim 1 wherein said magnetic means includes a rotatable cylindrical member located adjacent to the charge pattern bearing member with the longitudinal axis of said cylindrical member extending laterally with respect to such member, said cylindrical member having alternating magnetic poles extending along elements of such cylindrical member, and means for rotating said cylindrical member whereby said alternating magnetic pole agitate the portion of such developer material in the agitated zone.

3. In magnetic brush developer apparatus for developing an electrostatic charge pattern on a member movable along a travel path by contacting such member with particulate magnetic developer material, such apparatus including a housing for containing such material, an applicator mounted in said housing for movement in juxtaposition with such movable member, means for magnetically attracting such material to said applicator to form a nap of material bristles on such applicator, and means for relatively moving said applicator and said magnetic means to move such bristles into contact relation with the charge pattern on such moving member, the improvement comprising:

auxiliary magnetic means, located in said housing and associated with said applicator, for agitating a portion of said nap to form in said nap an agitated zone bounded by the non-agitated nap to establish a sealing zone about the agitated zone.

4. In a method of developing an electrostatic charge pattern on a member with particulate magnetic developer material by the steps of forming such material into bristles in a magnetic field and moving such bristles into contact with the charge pattern bearing member, the improvement comprising:

agitating a portion of the developer material in contact with the charge pattern bearing member in an alternating magnetic field to form in such material an agitated zone bounded by the non-agitated bristles to establish a sealing zone about the agitated zone.

* * * * *